US008448614B1

(12) United States Patent
Gu

(10) Patent No.: US 8,448,614 B1
(45) Date of Patent: May 28, 2013

(54) FOUR-STROKE ENGINE WITHOUT A CRANKSHAFT AND VALVES

(71) Applicant: Ruei-Ting Gu, Kaohsiung (TW)

(72) Inventor: Ruei-Ting Gu, Kaohsiung (TW)

(73) Assignees: Ruei-Ting Gu, Kaohsiung (TW); Kuo-Chen Weng, Tainan (TW)

( * ) Notice: Subject to any disclaimer, the term of this patent is extended or adjusted under 35 U.S.C. 154(b) by 0 days.

(21) Appl. No.: 13/658,206

(22) Filed: Oct. 23, 2012

(51) Int. Cl.
*F02B 75/26* (2006.01)

(52) U.S. Cl.
USPC ..... 123/56.1; 123/56.2; 123/197.1

(58) Field of Classification Search
USPC ..... 123/56.1, 56.2, 56.7, 56.8, 56.9, 123/197.1, 197.3, 197.4
See application file for complete search history.

(56) References Cited

U.S. PATENT DOCUMENTS 3,895,614 A * 7/1975 Bailey ..... 123/67
5,452,689 A * 9/1995 Karlan ..... 123/56.2
5,562,075 A * 10/1996 Walsh ..... 123/197.1
5,992,357 A * 11/1999 Tasi ..... 123/56.2
7,451,687 B2 * 11/2008 Lynn et al. ..... 92/12.2
2006/0288971 A1 * 12/2006 Tasi et al. ..... 123/56.1

FOREIGN PATENT DOCUMENTS

DE 3419582 A1 * 11/1985

* cited by examiner

*Primary Examiner* — Noah Kamen
*Assistant Examiner* — Grant Moubry
(74) *Attorney, Agent, or Firm* — Alan Kamrath; Kamrath IP Lawfirm, P.A.

(57) ABSTRACT

A four-stroke engine without a crankshaft and valves contains a base including a gas groove, a first cylinder, a second cylinder, two gas flowing holes, a first inlet, a first outlet, and a holder; a gas valve including a connecting rod, a second inlet, and a second outlet; a driving device including two pushing posts, a rotating arm, a rotary shaft; a gear set including a panel, an upper gear, and a bottom gear, wherein the drive gear has a second tilted bar, the second tilted bar has a second opening arranged thereon, a second rotatable bearing; a seat including a peripheral side coupling with a top rim of the holder, a fixed pole axially connecting with the holder and the base; wherein a top end of the rotary shaft extends out of the seat.

3 Claims, 16 Drawing Sheets

FOUR-STROKE ENGINE WITHOUT A CRANKSHAFT AND VALVES

BACKGROUND OF THE INVENTION

1. Field of the Invention

The present invention relates to a four-stroke engine, and more particularly to a four-stroke engine without a crankshaft and valves which includes a rotatable gas groove and a specific gas feeding and exhausting operation and matches with a rotating arm and a rotary shaft in a driving device and allowing obtaining a rotating speed ration between gear set so as to cycle gas feeding, compression, burst, and gas exhausting.

2. Description of the Prior Art

A cycling operation of a conventional engine has two or four strokes, and a power is supplied to the engine by a crankshaft, i.e., the crankshaft is an output shaft of the engine. However, a top end and a bottom end of the crankshaft can not communicate with each other, so the crank shaft is formed in a curve shape based on a number of the at least one piston so that a vertical movement of a piston is transferred into a rotational movement. But as the at least one piston moves linearly upward and downward, a curved portion of the crank shaft is eccentric, so that the at least one piston moves eccentrically upward and downward, and then the at least one piston produces a lateral force to rub at least one cylinder, thus wearing and breaking the at least one piston and the at least one cylinder.

In addition, the conventional engine is provided with plural gas valve sets so as to operate gas feeding, compression, burst, and gas exhausting, accordingly the engine has a complicated structure.

The present invention has arisen to mitigate and/or obviate the afore-described disadvantages.

SUMMARY OF THE INVENTION

The primary object of the present invention is to provide a four-stroke engine without a crankshaft and valves which allows providing a gear set so as to control a rotating speed ratio among a rotary shaft, a rotating arm, and a gas valve, such that the gas valve operates continuously and feed gas into a first cylinder and a second cylinder and exhaust gas out of the first cylinder and the second cylinder, thus cycling gas feeding, compression, burst, and gas exhausting.

Secondary object of the present invention is to provide a four-stroke engine without a crankshaft and valves which includes the gear set to decrease speed stroke so that the gas valve rotates 360 degrees in the base and has gas feeding and gas exhausting operation, and a rotating speed ratio of the rotating arm is two times equal to or more than that of the gas valve.

Further object of the present invention is to provide a four-stroke engine without a crankshaft and valves which allows two pistons and two pushing posts reciprocately moving upward and downward without producing a later force so as to prevent a wear and a break of the two pistons, the first cylinder, and the second cylinder, thus prolonging service life of the four-stroke engine.

Another object of the present invention is to provide a four-stroke engine without a crankshaft and valves which after a vertical length of a fixed pole and a holder is selected, a limit height in the first cylinder and the second cylinder is determined based on the rotary shaft, the rotating arm, the two pushing posts, and the two pistons, such that the first cylinder and the second cylinder have various compression ratios, hence the four-stroke engine is applicable for diesel fuel and gasoline fuel.

A four-stroke engine without a crankshaft and valves contains:

a base including a gas groove defined thereon and a first cylinder and a second cylinder symmetrically arranged around a center of the gas groove, two gas flowing holes defined in the base and communicating with the gas groove, the first cylinder and the second cylinders, a first inlet formed on a side wall of the gas groove and communicating with an exterior of the gas groove, and a first outlet defined on a bottom end of the gas groove and communicating with the exterior of the gas groove, wherein the base also includes the a holder connected with a top surface thereof for covering the gas groove, the first cylinder, and the second cylinder, a bottom plate of the holder has two first orifices, two second orifices, a third orifice between the two first orifices, a fourth orifice between the two second orifices, and plural fifth orifices formed thereon, the first orifices and the third orifice communicate with the first cylinder, and the second orifices and the fourth orifice communicate with the second cylinder;

a gas valve including one end formed in a circle shape and a connecting rod connected on a central position of a top surface thereof, the gas valve being disposed in the gas groove and also including a second inlet for communicating with the two gas flowing holes and the first inlet and including a second outlet for communicating with the first outlet; wherein an angle between the second inlet and the second outlet is 90 degree, and the gas valve also includes a first bearing, mounted on the top surface of the gas valve, extending out of the third orifice and the fourth orifice the bottom plate, and connecting with a second bearings inserted into the third orifice and the fourth orifice so as to couple with a driven gear of a gear set of a driving device;

a holder connected with the top surface of the base and formed in a hollow square shape, the bottom plate of the holder having the two first orifices, the two second orifices, the third orifice, the fourth orifice, and the plural fifth orifices formed thereon, the holder being formed in the hollow square shape so as to receive the gear set and the driving device;

the driving device including two pushing posts for connecting with two pistons, a rotating arm formed in a cross shape and coupling with the two top ends of the two pushing posts, a rotary shaft connecting with a top end of the rotating arm, and the gear set coupling with a bottom end of the rotating arm; wherein the two pushing posts include the two pistons disposed on two bottom ends thereof and inserted into the first cylinder and the second cylinder through a bottom end of the holder; the rotating arm includes a tube having two receiving spaces, two supports having two first ends inserted into the two receiving spaces and two second ends coupling with the two top ends of the two pushing posts, a first guide peg having a first segment connecting with a top rim of the tube and a second segment fixed in the first rotatable bearing of the first opening, and a second guide peg having a first side coupling with a bottom rim of the tube and a second side symmetrical to the first guide peg, such that the rotating arm is formed in the cross shape, and the tube also has two apertures formed thereon for communicating with the two receiving spaces so that the two supports move in the two receiving spaces reciprocately;

the gear set includes a panel having two ends connecting with the bottom plate of the holder so as to form a room, an upper gear and a bottom gear inserted into and being coaxial with a top portion of the panel, a drive gear and the driven gear coupling with the bottom portion of the panel by using two rotary stems and meshing with the upper gear and the lower gear, wherein the drive gear has a second tilted bar mounted thereon for corresponding to a first tilted bar, the second tilted bar has a second opening arranged thereon, a second rotatable bearing received in the second opening, such that a distal end of the second guide peg inserts in the second rotatable bearing, and a rotary stem of the driven gear is in connection with a top end of the connecting rod of the gas valve so that when the drive gear rotates two circles, the driven gear is driven by the upper gear and the lower gear to rotate one circle, so the gear set is used to control a rotating speed ratio of the rotary shaft or the rotating arm and the gas valve, and the rotating speed ratio is □ two times; the rotary shaft includes a vertical extension and a horizontal extension being perpendicular to the vertical extension and in connection with the vertical extension, wherein the vertical extension extends out of the seat and is connected with the seat by a third bearing, the horizontal extension located under the seat and has a first tilted bar obliquely extending from one end thereof, and the first tilted bar has an first opening defined thereon, the first opening has a first rotatable bearing secured therein, a distal end of the gear set connects with the connecting rod of the gas valve;

the seat including a peripheral side coupling with a top rim of the holder, a fixed pole axially connecting with the holder and the base; wherein a top end of the rotary shaft extends out of the seat.

BRIEF DESCRIPTION OF THE DRAWINGS

FIG. 5A1 is a partial enlarged diagrams showing the operation of the four-stroke engine of FIG. 4 according to the first embodiment of the present invention.

FIG. 5A2 is another partial enlarged diagrams showing the operation of the four-stroke engine of FIG. 4 according to the first embodiment of the present invention.

FIG. 5B1 is a partial enlarged diagrams showing the operation of the four-stroke engine of FIG. 4 according to the first embodiment of the present invention.

FIG. 5B2 is another partial enlarged diagrams showing the operation of the four-stroke engine of FIG. 4 according to the first embodiment of the present invention.

DETAILED DESCRIPTION OF THE PREFERRED EMBODIMENTS

Figure 1A:
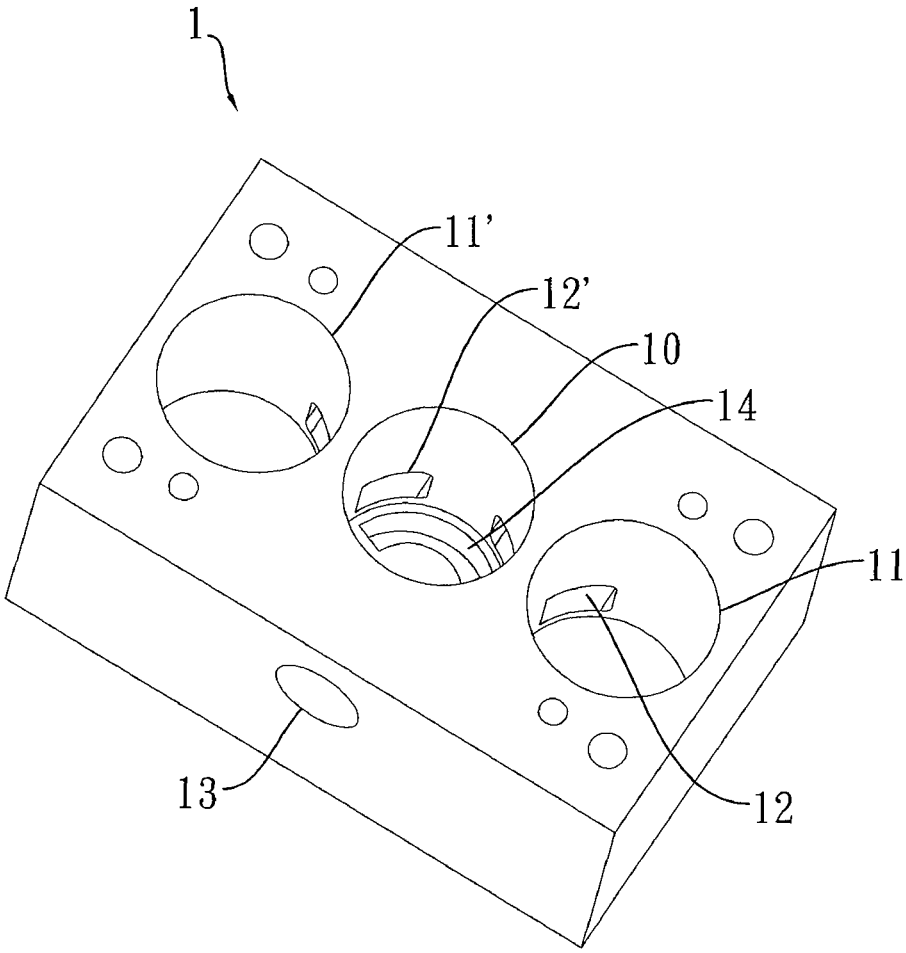
FIG. 1A is a perspective view showing the assembly of a base of a four-stroke engine according to a first embodiment of the present invention.
Figure 1B:
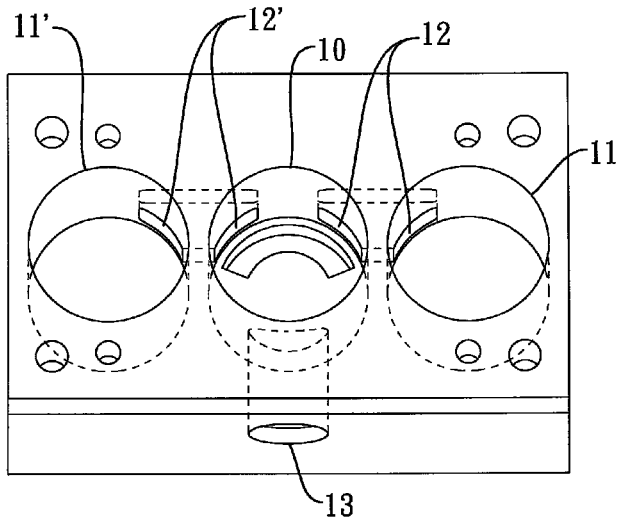
FIG. 1B is a plan view showing the assembly of the base of the four-stroke engine according to the first embodiment of the present invention.

The present invention will be clearer from the following description when viewed together with the accompanying drawings, which show, for purpose of illustrations only, the preferred embodiment in accordance with the present invention.

With reference to FIGS. 1A, 1B, 2, 2A and 3, a four-stroke engine without a crankshaft and valves according to a first embodiment of the present invention comprises a base 1, a gas valve 2, a holder 16, a driving device 3, and a seat 4.

The base 1 (as shown in FIGS. 1A, 1B, 2 and 2A) includes a gas groove 10 defined thereon and a first cylinder 11 and a second cylinder 11' symmetrically arranged around a center of the gas groove 10, two gas flowing holes 12, 12' defined in the base and communicating with the gas groove 10, the first cylinder 11 and the second cylinders 11', a first inlet 13 formed on a side wall of the gas groove 10 and communicating with an exterior of the gas groove 10, and a first outlet 14 defined on a bottom end of the gas groove 10 and communicating with the exterior of the gas groove 10; wherein a bottom plate 162 of the holder 16 is screwed on a top surface of the base 1 by ways of plural screw elements 15, such that the gas groove 10, the first cylinder 11, and the second cylinder 11' of the base 1 are covered by the bottom plate 162. In addition, the gas groove 10 includes a washer 17 fixed on a top rim thereof so that the holder 16 closes the gas groove 10.

Figure 2A:
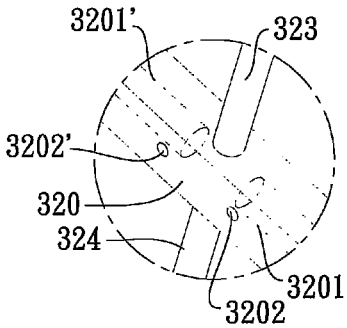
FIG. 2A is a partial enlarged diagram showing the assembly of the four-stroke engine according to the first embodiment of the present invention.
Figure 2:
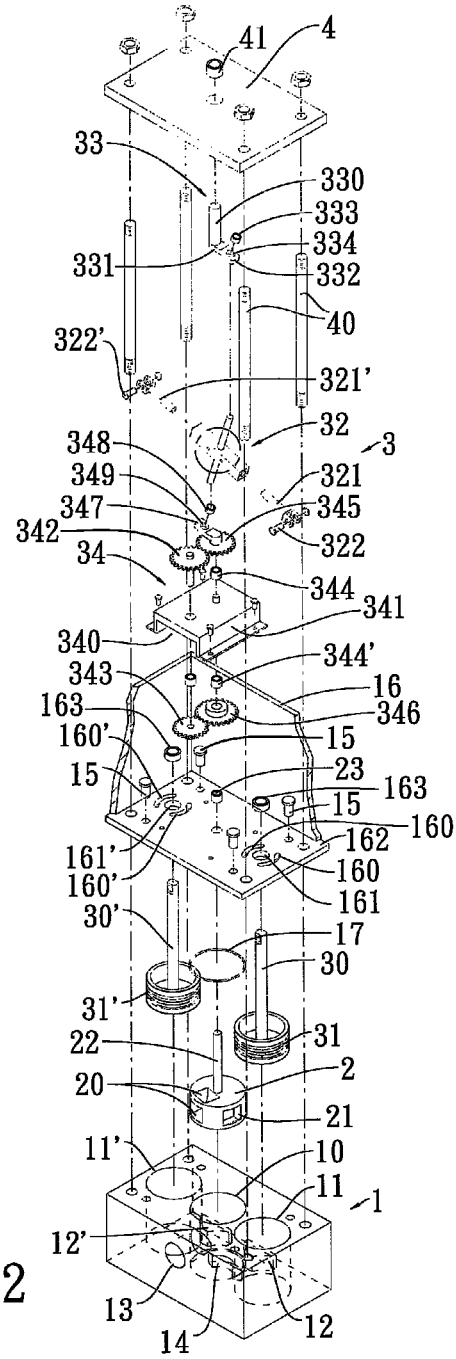
FIG. 2 is a perspective view showing the assembly of the four-stroke engine according to the first embodiment of the present invention.
Figure 3:
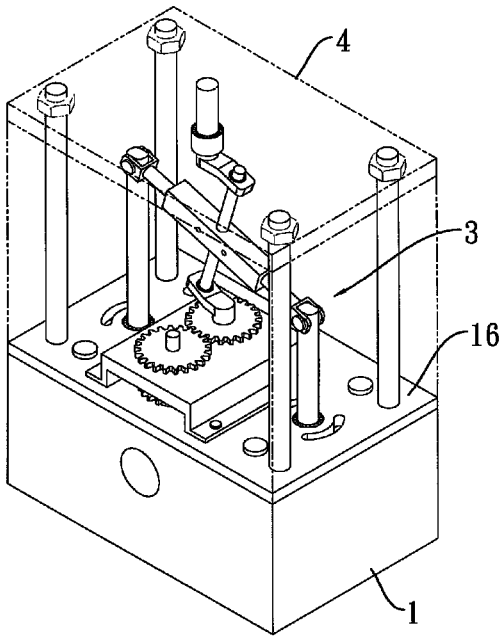
FIG. 3 is a perspective view showing the assembly of the four-stroke engine according to the first embodiment of the present invention.

The gas valve 2 (as illustrated in FIGS. 2 and 2A) is disposed in the gas groove 10 and includes a second inlet 20 for communicating with the two gas flowing holes 12, 12' and the first inlet 13 and includes a second outlet 21 for communicating with the first outlet 14; wherein an angle between the second inlet 20 and the second outlet 21 is 90 degree, and the gas valve 2 also includes a first bearing 23 (such as a thrust bearing), mounted on a top surface of the gas valve 2, extending out of the bottom plate 162, and rotating a connecting rod 22 of the gas valve 2.

The holder 16 (as shown in FIGS. 2 and 2A) is connected with the top surface of the base 1 and is formed in a hollow square shape, the bottom plate 162 of the holder 16 has two first orifices 160, two second orifices 160', a third orifice 161 between the two first orifices 160, a fourth orifice 161' between the two second orifices 160', and plural fifth orifices formed thereon, wherein the first orifices 160 and the third orifice 161 communicate with the first cylinder 11, and the second orifices 160' and the fourth orifice 161' communicate with the second cylinder 11', the holder 16 is formed in the hollow square shape so as to receive a gear set 34 and the driving device 3.

The driving device 3 (as shown in FIGS. 2 and 2A) includes two pushing posts 30, 30' for connecting with two pistons 31, 31' (two top ends of the two pushing posts 30, 30' insert into the first cylinder 11 and the second cylinder 11' via the third orifice 161 and the fourth orifice 161' of the bottom plate 162 and move upward and downward stably through two second bearings 163 of the third orifice 161 and the fourth orifice 161', two bottom ends of the two pushing posts 30; 30' include the two pistons 31, 31' disposed thereon and include two diameters corresponding to those of the first cylinder 11 and the second cylinder 11'), a rotating arm 32 formed in a cross shape and coupling with the two top ends of the two pushing posts 30, 30', a rotary shaft 33 connecting with a top end of the rotating arm 32, and the gear set 34 coupling with a bottom end of the rotating arm 32; wherein the rotary shaft 33 includes a vertical extension 330 and a horizontal extension 331 being perpendicular to the vertical extension 330 and in connection with the vertical extension 330, the horizontal extension 331 has a first tilted bar 332 obliquely extending from one end thereof, and the first tilted bar 332 has an first opening 334 defined thereon, the first opening 334 has a first rotatable bearing 333 secured therein; the rotating arm 32 includes a tube 320 having two receiving spaces 3201, 3201', two supports 321, 321' having two first ends inserted into the two receiving spaces 3201, 3201', two second ends coupling with the two top ends of the two pushing posts 30, 30' (the two pushing posts 30, 30' and the supports 321, 321' are connected together by means of two pivots 322, 322' so as to form a rotary free degree), a first guide peg 323 having a first segment connecting with a top rim of the tube 320 and a second segment fixed in the first rotatable bearing 333 of the first opening 334 (so that a rotary free degree is formed between the first guide peg 323 and the first rotatable bearing 333), and a second guide peg 324 having a first side coupling with a bottom rim of the tube 320 and a second side symmetrical to the first guide peg 323, such that the rotating arm 32 is formed in the cross shape, and the tube 320 also has two apertures 3202, 3202' formed thereon for communicating with the two receiving spaces 3201, 3201' so that the two supports 321, 321' move in the two receiving spaces 3201, 3201' reciprocately, hence gas in the two receiving spaces 3201, 3201' exhausts outwardly. The gear set 34 includes a panel 341 having two ends connecting with the bottom plate 162 of the holder 16 so as to form a room 340, an upper gear 342 and a bottom gear 343 inserted into and being coaxial with a top portion of the panel 341, a drive gear 345 and a driven gear 346 coupling with the bottom portion of the panel 341 by using two rotary stems 344, 344' and meshing with the upper gear 342 and the lower gear 343, wherein the drive gear 345 has a second tilted bar 347 mounted thereon for corresponding to the first tilted bar 332, the second tilted bar 347 has a second opening 349 arranged thereon, a second rotatable bearing 348 received in the second opening 349, such that a distal end of the second guide peg 324 inserts in the second rotatable bearing 348 (so that a rotary free degree is formed between the second guide peg 324 and the second rotatable bearing 348), and a rotary stem 344' of the driven gear 346 is in connection with a top end of the connecting rod 22 of the gas valve 2 so that when the drive gear 345 rotates two circles, the driven gear 346 is driven by the upper gear 342 and the lower gear 343 to rotate one circle. In other words, the gear set 34 is used to control a rotating speed ratio of the rotary shaft 33 or the rotating arm 32 and the gas valve 2, and the rotating speed ratio is □ two times.

The seat 4 (as illustrated in FIGS. 2 and 2A) has a peripheral side coupling with a top rim of the holder 16, a fixed pole 40 axially connecting with the holder 16 and the base 1 and screwed by a nut 42; wherein the vertical extension 330 of the rotary shaft 33 extends out of the seat 4, and the vertical extension 330 and the seat 4 are fixed together by a third bearing 41 (such as a thrust bearing) so that the vertical extension 330 has an axially rotary free degree.

After connecting the base 1, the gas valve 2, the holder 16, the driving device 3, and the seat 4 together, lubricating oil is fed into the holder 16 so that the drive device 3 operates smoothly.

Figure 4:
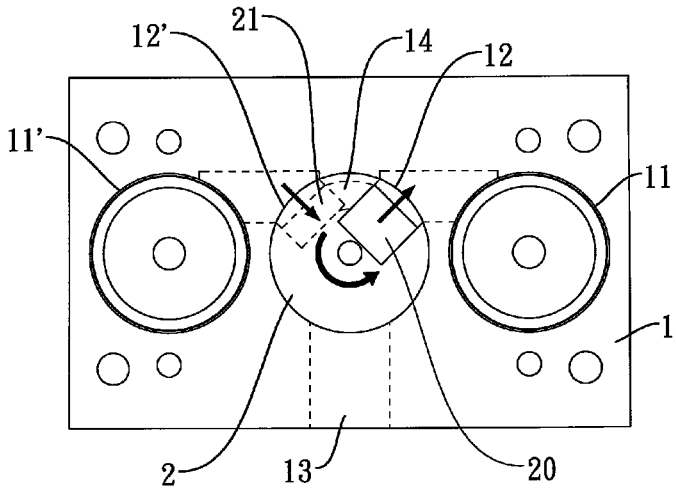
FIG. 4 is a plan view showing a gas valve controlling a gas feeding and a gas exhausting in a first cylinder and a second cylinder according to the first embodiment of the present invention.
Figure 5A:
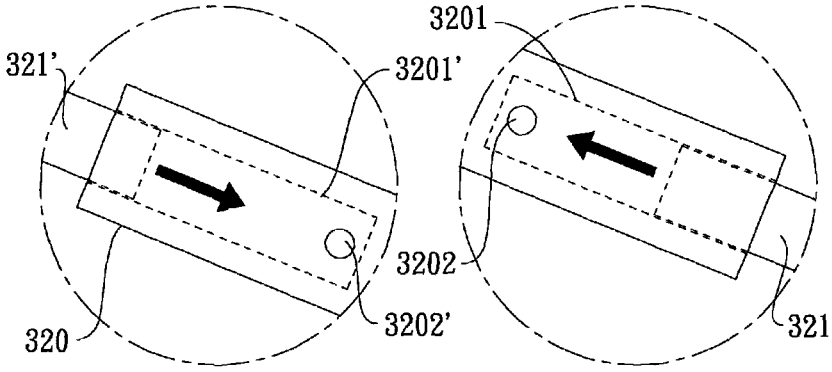
FIG. 5A is a plan view showing the operation of the four-stroke engine of FIG. 4 according to the first embodiment of the present invention.
Figure 5A:
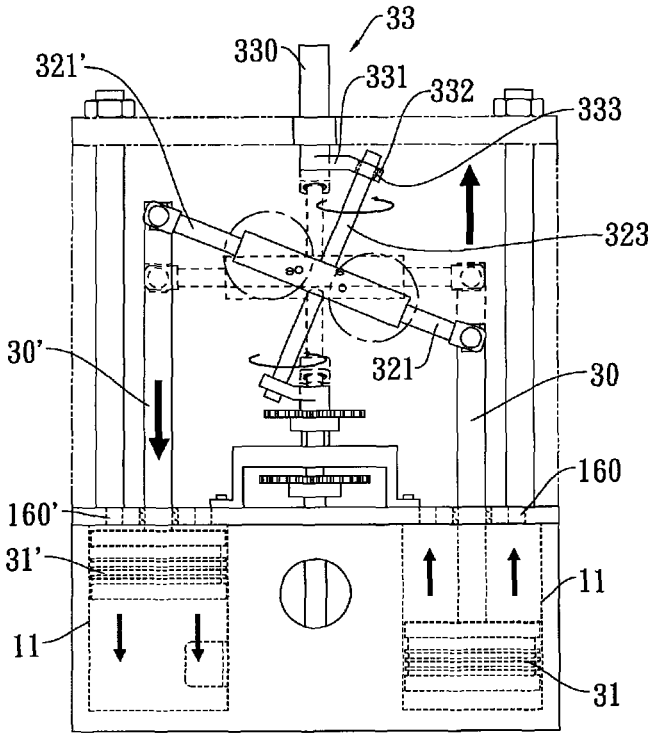
Figure 5B:
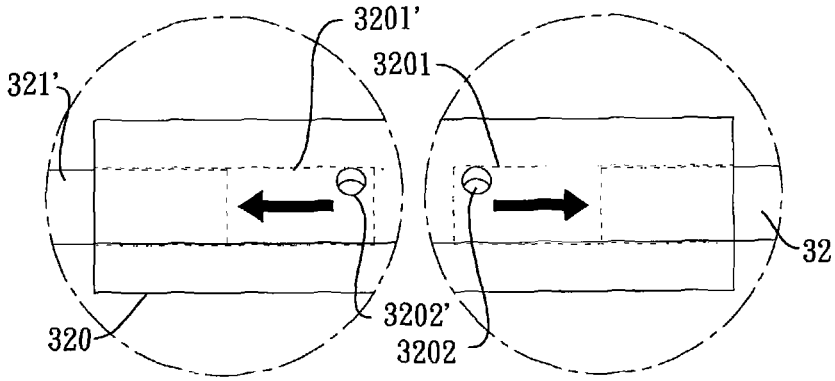
FIG. 5B is another plan view showing the operation of the four-stroke engine of FIG. 4 according to the first embodiment of the present invention.
Figure 5B:
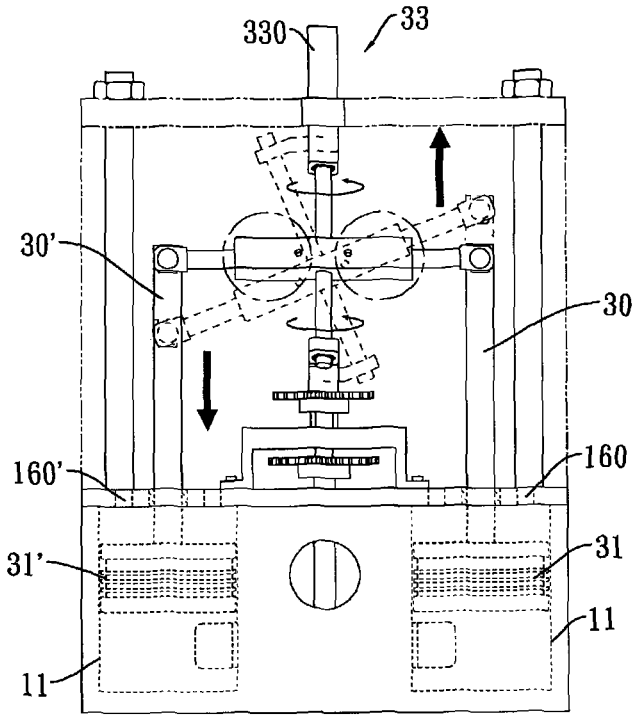
Figure 6:
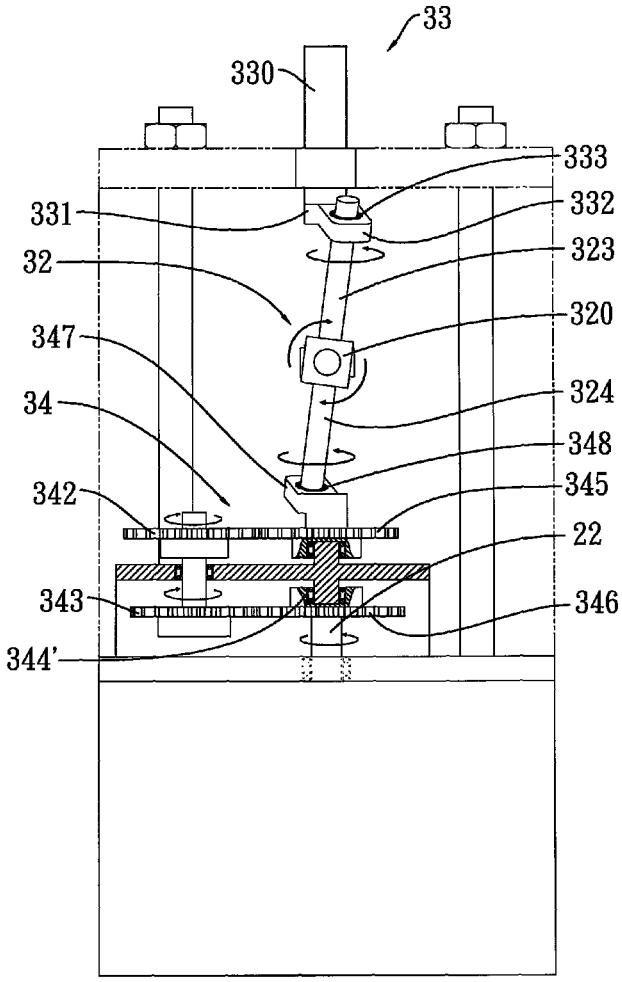
FIG. 6 is another plan view showing the operation of the four-stroke engine according to the first embodiment of the present invention.

As shown in FIG. 4, when the four-stroke engine starts operation, the second inlet 20 and the second outlet 21 of the gas valve 2 correspond to a gas flowing hole 12 of the first cylinder 11 and a gas flowing hole 12' of the second cylinder 11' so that the gas flows into the first cylinder 11 via the first inlet 13 of the base 1, the second inlet 20 of the gas valve 2, the gas flowing hole 12 of the first cylinder 11, and the gas in the second cylinder 11' flows out of the first outlet 14 of the base 1 through the second outlet 21 of the gas valve 2 and the gas flowing hole 12' of the second cylinder 11' so that the gas valve 2 flows the gas into the first cylinder 11 and out of the second cylinder 11'.

As illustrated in FIGS. 5A, 5A1, 5A2, 5B, 5B1, 5B2 and 6, when the gas flows into the first cylinder 11 via the gas flowing hole 12, the gas pushes a piston 31 and a pushing post 30 of the first cylinder 11 upwardly, and the gas in the second cylinder 11' flows outwardly via the gas flowing hole 12' of the second cylinder 11' so to push a piston 31' and of a pushing rod 30' of the second cylinder 11' downwardly, wherein the piston 31 and the pushing post 30 reciprocately move upward and downward in the first cylinder 11, and the piston 31' and the pushing post 30' move upward and downward in the second cylinder 11'. Since the piston 31 and the pushing post 30 reciprocately push outward and inward in the first cylinder 11, and the piston 31' and the pushing post 30' push outward and inward in the second cylinder 11', the gas in the first cylinder 11 and the gas in the second cylinder 11' flow out of or into the two first orifices 160 and the two second orifices 160', such that the piston 31, the pushing post 30 and piston 31', the pushing post 30' reciprocately move upward and downward in the first cylinder 11 and the second cylinder 11'. Thereby, a support 321 of the pushing post 30 reciprocately moves outward and inward in a receiving space 3201, and a support 321' of the pushing post 30' reciprocately moves outward and inward in a receiving space 3201 by using the pushing post 30', wherein the two supports 321, 321' reciprocately move in the two receiving space 3201, 3201'. Due to the two supports 321, 321' push inward or outward in the two receiving spaces 3201, 3201', gas in the two receiving spaces 3201, 3201' flow outward or inward through the two apertures 3202, 3202' so that the two supports 321, 321' move reciprocately in the two receiving spaces 3201, 3201'. And when the two supports 321, 321' reciprocately move in the two receiving spaces 3201, 3201', the first guide peg 323 of the tube 320 is limited by the first rotatable bearing 333 of the first tilted bar 332 of the rotary shaft 33 so that the first guide peg 323 drives the first tilted bar 332, the horizontal extension 331, and the vertical extension 330 to rotate in an anti-clockwise direction, thus generating a rotational energy.

During a rotation of the first guide peg 323, the second guide peg 324 rotates relative to the first guide peg 323 in the anti-clockwise direction so as to further drive the drive gear 345, such that the upper gear 342, the lower gear 343, and the driven gear 346 are driven by the drive gear 345, and then the upper gear 342, the lower gear 343, and the driven gear 346 drive the connecting rod 22 of the gas valve 2 to rotate in the anti-clockwise direction with a rotary stems 344' which rotates with the driven gear 346.

Thereby, when the gas valve 2 flows the gas inward or outward, the two pushing posts 30, 30' operate to drive the rotating arm 32 to swing so that the rotary shaft 33 produces the rotational energy and drives the gear set 34, and thereafter the gear set 34 drives the connecting rod 22 of the gas valve 2 so that the gas valve 2 rotates in the anti-clockwise direction as well.

It is to be noted that as the two pushing posts 30, 30' push upward and downward, a lateral force does not produce, such that the two pistons 31, 31' do not wear and break the first cylinder 11 and the second cylinder 11', thus prolonging a service life of the four-stroke engine.

Figure 7:
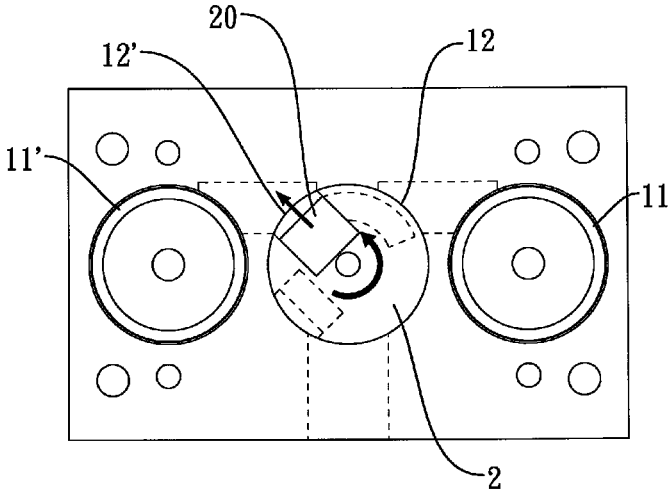
FIG. 7 is a plan view showing the gas valve controlling the gas feeding and a compression in the first cylinder and the second cylinder according to the first embodiment of the present invention.
Figure 8:
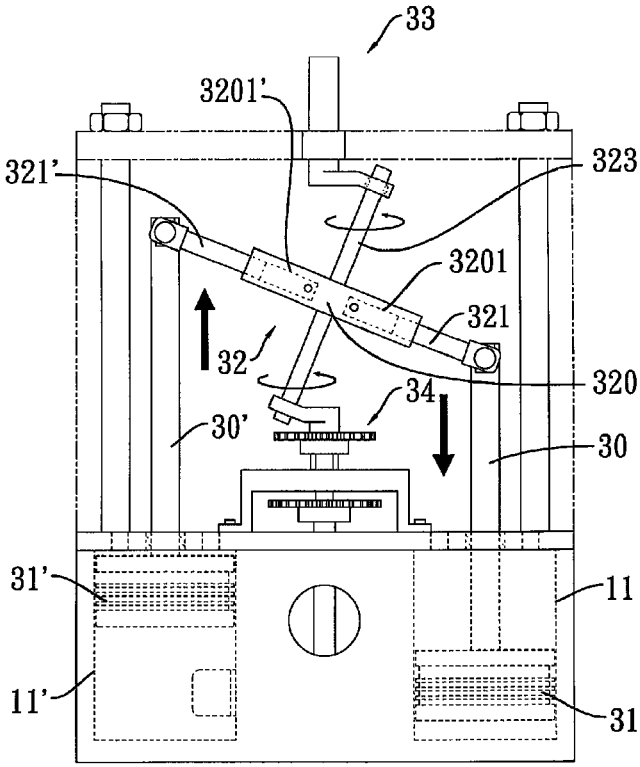
FIG. 8 is a plan view showing the operation of the four-stroke engine of FIG. 7 according to the first embodiment of the present invention.

Referring further to FIGS. 7 and 8, after the first cylinder 11 and the second cylinder 11' flow the gas inward and outward, since the gas valve 2 rotates in the anti-clockwise direction continuously, the gas valve 2 rotates as shown in FIG. 7 so that the gas flowing hole 12' of the second cylinder 11' is in communication with the second inlet 20 of the gas valve 2, and the gas is pushed into the second cylinder 11', the gas flowing hole 12 of the first cylinder 11 is covered by an outer wall of the gas valve 2, thus closing the first cylinder 11.

With reference to FIG. 8, after the gas flows into the second cylinder 11' through the gas flowing hole 12' of the second cylinder 11', it pushes the piston 31' and the pushing post 30' of the second cylinder 11'. In the meantime, since the gas flowing hole 12' of the second cylinder 11' is limited and covered by the outer wall of the gas valve 2, the piston 31 and the pushing post 30 of the first cylinder 11 compress the gas in the first cylinder 11; thereby when the two pushing posts 30', 30 push upward and downward, the support 321 of the pushing post 30 reciprocately moves inward and outward in the receiving space 3201, and the support 321' of the pushing post 30' is driven by the pushing post 30' to reciprocately move inward and outward in the receiving space 3201'; and during the two supports 321, 321' reciprocately move in the two receiving spaces 3201, 3201', the first guide peg 323 of the tube 320 also drives the rotary shaft 33 to move. Because a driving operation has been description above, further remarks are omitted.

During the rotating arm 32 swings with the rotation of the first guide peg 323, the gear set 34 and the gas valve 2 are driven by the rotating arm 32 so that the second cylinder 11' and the first cylinder 11 flow the gas inward and compress, and the gas valve 2 rotates in the anti-clockwise direction. Since the above-mentioned description has described that the rotating arm 32 drives the gear set 34 and the gas valve 2, further remarks are omitted.

Figure 9:
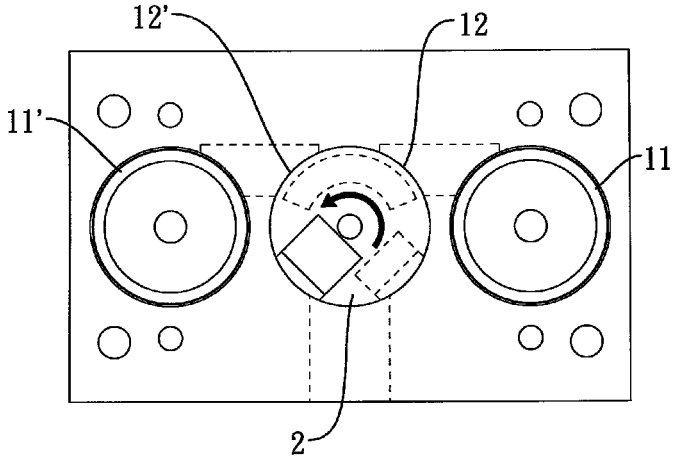
FIG. 9 is a plan view showing the gas valve controlling a burst and the compression in the first cylinder and the second cylinder according to the first embodiment of the present invention.
Figure 10:
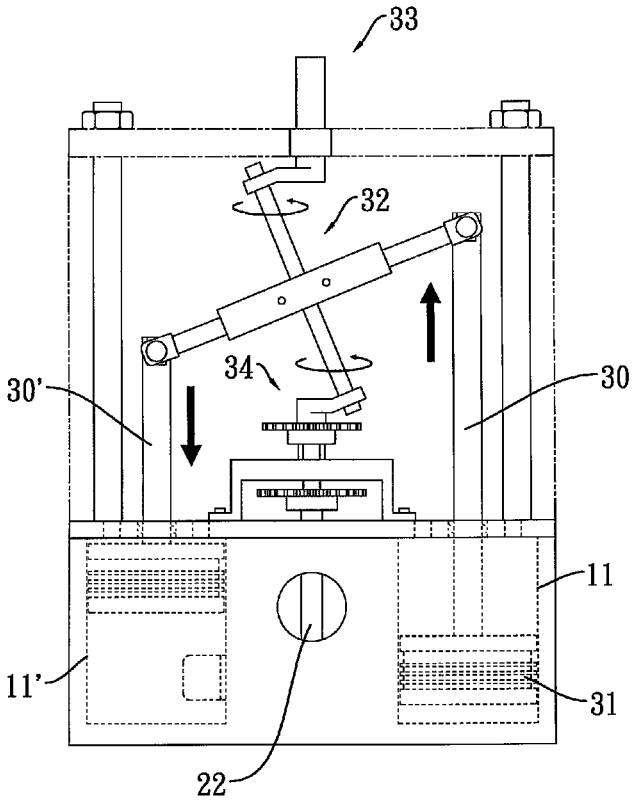
FIG. 10 is a plan view showing the operation of the four-stroke engine of FIG. 9 according to the first embodiment of the present invention.

With reference to FIGS. 9 and 10, after the first cylinder 11 and the second cylinder 11' compress and flow the gas, the gas valve 2 continuously rotates in the anti-clockwise direction so that the gas valve 2 operates as shown in FIG. 9, wherein the gas flowing hole 12 of the first cylinder 11 and the gas flowing hole 12' of the second cylinder 11' are covered by the outer wall of the gas valve 2, and the first cylinder 11 and the second cylinder 11' are closed.

As shown in FIG. 10. after the gas in the first cylinder 11 is compressed downwardly to a set stroke, the gas and oil spray directly in the first cylinder 11, and then the oil and the gas, which are mixed in the first cylinder 11, light and burst so that the piston 31 and the pushing post 30 of the first cylinder 11 are pushed upward, and the piston 31' and the pushing post 30' compress the gas in the second cylinder 11' downwardly; hence the pushing posts 30, 30' push upward and downward reciprocately so as to drive the rotating arm 32 to swing. In the meantime, the rotating arm 32 drives the rotary shaft 33 and the gear set 34, such that a movement of the rotary shaft 33 changes into a rotation so as to produce the rotational energy, and the gear set 34 drives the connecting rod 22 of the gas valve 2 so that the gas valve 2 rotates 360 degrees in the anti-clockwise direction. From above-mentioned description, it has disclosed that the two pushing posts 30, 30' drive the rotating arm 32, the rotary shaft 33, and the gear set 34 and an operation of the gas valve 2, so further remarks are omitted.

Figure 11:
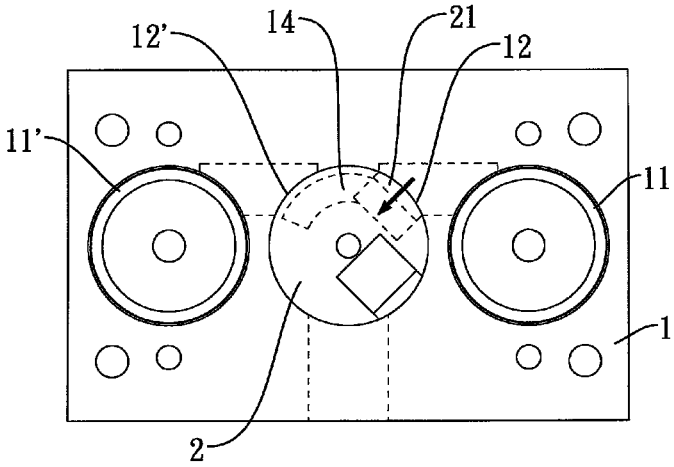
FIG. 11 is a plan view showing a gas exhausting controlling the burst and the compression in the first cylinder and the second cylinder according to the first embodiment of the present invention.

Referring further to FIGS. 4, 5A, 5A1, 5A2, 5B, 5B1, 5B2, 11 and 12, after the first cylinder 11 and the second cylinder 11' light and compress the gas, the gas valve 2 rotates in the anti-clockwise direction continuously as shown in FIG. 11, hence the gas flowing hole 12 of the first cylinder 11 communicates with the second outlet 21 of the gas valve 2 and the first outlet 14 of the base 1; and the gas flowing hole 12' of the second cylinder 11' is covered by the outer wall of the gas valve 2 so that the second cylinder 11' is closed.

Figure 12:
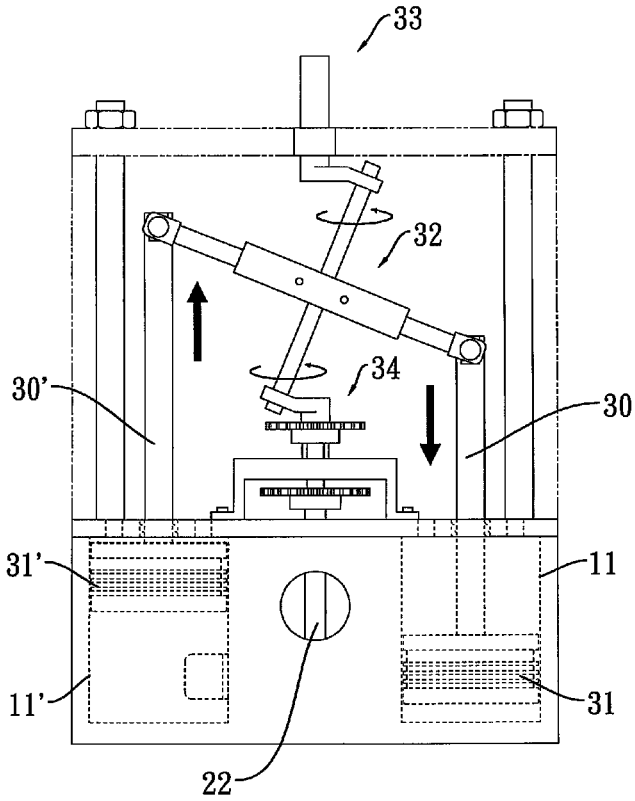
FIG. 12 is a plan view showing the operation of the four-stroke engine of FIG. 11 according to the first embodiment of the present invention.

As illustrated in FIG. 12, after a burst of the first cylinder 11, waste gas exhausts through the gas flowing hole 12, the second outlet 21 of the gas valve 2, and the first outlet 14 of the base 1 (i.e., having a gas exhaust) so that the piston 31 and the pushing post 30 push downward in the first cylinder 11, and after the gas in the second cylinder 11' is compressed downward to a set stroke by the piston 31, the oil and the gas directly spray in the second cylinder 11' so that the oil and the gas, which are mixed in the second cylinder 11', light and burst instantly so that the piston 31' and the pushing post 30' push upward in the second cylinder 11'; the rotating arm 32 is pushed by the two pushing posts 30, 30' downward and upward reciprocately to swing. In the meantime, the rotating arm 32 drives the rotary shaft 33 and the gear set 34, such that the movement of the rotary shaft 33 changes into the rotation so as to produce the rotational energy, and the gear set 34 drives the connecting rod 22 of the gas valve 2 so that the gas valve 2 rotates 360 degrees in the anti-clockwise direction. From above-mentioned description, it has disclosed that the two pushing posts 30, 30' drive the rotating arm 32, the rotary shaft 33, and the gear set 34 and the operation of the gas valve 2, so further remarks are omitted.

After the first cylinder 11 and the second cylinder 11' exhaust the gas and burst, the gas valve 2 rotates in the anti-clockwise direction continuously as shown in FIG. 4 so that the second inlet 20 and the second outlet 21 of the gas valve 2 correspond to the gas flowing hole 12 of the first cylinder 11 and the gas flowing hole 12' of the second cylinder 11' again, so the first cylinder 11 starts the gas exhaust again, the waste gas exhausts through the gas flowing hole 12' of the second cylinder 11', the second outlet 21 of the gas valve 2, and the first outlet 14 of the base 1, thus operating the four-stroke engine as illustrated in FIGS. 5A, 5A1, 5A2, 5B, 5B1 and 5B2.

Thereby, the four-stroke engine of the present invention has a simply structure so that the gas valve 2 allows feeding and exhausting the gas into and out of the first cylinder 11 and the second cylinder 11', and then the first cylinder 11 is capable of operating four strokes, such as feeding gas, compression, burst, and exhausting gas. In addition, the first cylinder 11' corresponds to the first cylinder 11 so as to operate the four strokes, including exhausting gas, feeding gas, compression, and burst, thus cycling the four strokes of the four-stroke engine, such as feeding gas, compression, burst, and exhausting gas so as to produce the rotational energy.

Figure 13:
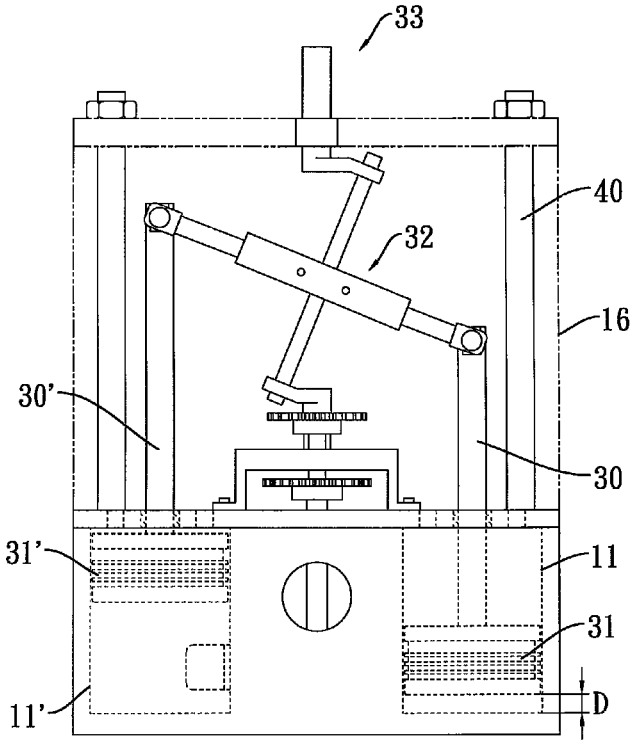
FIG. 13 is a plan view showing a compression ratio in the first cylinder and the second cylinder being controlled according to the first embodiment of the present invention.

To control a compression ratio of the first cylinder 11 and the second cylinder 11', as illustrated in FIG. 13, when a user installs a fixed pole 40 and a holder 16, a vertical length of the fixed pole 40 and the holder 16 is selected so that a limit height D (wherein the limit height D is changed according to a vertical length of the fixed pole 40 and the holder 16) in the first cylinder 11 and the second cylinder 11' is determined based on the rotary shaft 33, the rotating arm 32, the two pushing posts 30, 30', and the two pistons 31, 31', such that the first cylinder 11 and the second cylinder 11' have various compression ratios so that the four-stroke engine is applicable for diesel fuel of the first embodiment and gasoline fuel in the same engine structure.

Figure 14:
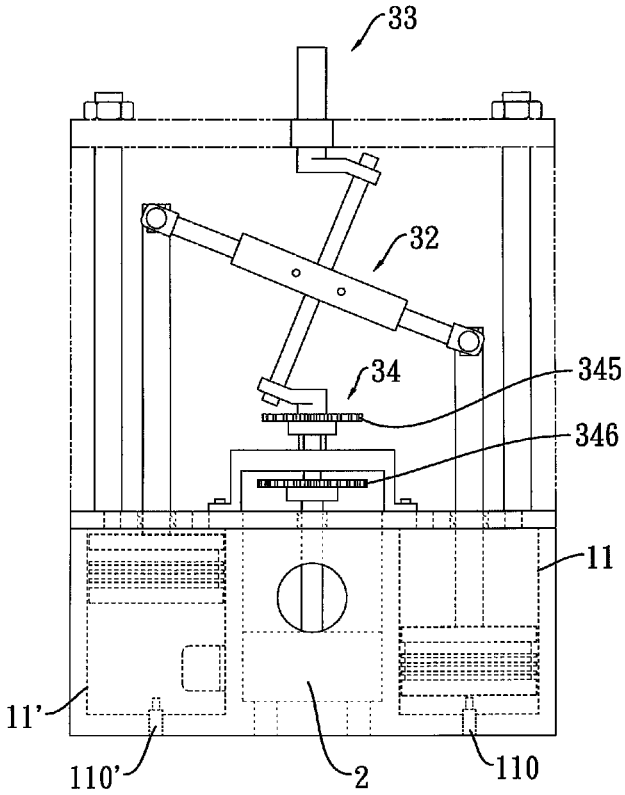
FIG. 14 is a plan view showing a first spark plug and a second spark plug being fixed in the first cylinder and the second cylinder being controlled according to a second embodiment of the present invention.

As shown in FIG. 14, when the first cylinder 11 and the second cylinder 11' are used in the gasoline fuel, the first cylinder 11 and the second cylinder 11' have to fix a first spark plug 110 and a second spark plug 110' so that when a compression operates in the first cylinder 11 or the second cylinder 11', the first spark plug 110 or the second spark plug 110' lights mixed gas in the first cylinder 11 or the second cylinder 11' so as to operation burst after the compression.

The first cylinder 11 and the second cylinder 11' are served to feed gas, compress, burst, and exhaust gas, and the gas valve 2 is used as a central point of the first cylinder 11 and the second cylinder 11' so that the first cylinder 11 and the second cylinder 11' are arranged symmetrically around the gas valve 2. A number of a rotating cycle of the driven gear 345 is two times more than the driven gear 346, i.e., the gear set 34 allows controlling a rotating speed ratio between the rotary shaft 33 or the rotating arm 32 and the gas valve is more than 2 times.

Thereby, the four-stroke engine of the present invention has the following advantages:

1. The two pistons and the two pushing posts reciprocately move upward and downward so as to push the two supports and the rotating arm such that the rotating arm pushes the rotary shaft to rotate, and the reciprocated movement is changed into the rotational movement.

2. The four-stroke engine is capable of controlling a rotating speed ratio between the rotary shaft or the rotating arm and the rotary shaft so that the gas valve feeds or exhausts the gas, hence the two pistons allow operating the four strokes, such as, feeding gas, compression, burst, and exhausting gas.

3. The vertical length of the fixed pole and the holder is applied to determine the limit height in the first cylinder and the second cylinder so that that the first cylinder and the second cylinder have various compression ratios so as to be suitable for the diesel fuel and the gasoline fuel.

4. The two pistons and the two pushing posts reciprocately move upward and downward without generating the lateral force, so the two pistons do not wear and break the first cylinder and the second cylinder, thus prolong service life.

While we have shown and described various embodiments in accordance with the present invention, it is clear to those skilled in the art that further embodiments may be made without departing from the scope of the present invention.

What is claimed is:

1. A four-stroke engine without a crankshaft and valves comprising:

a base including a gas groove defined thereon and a first cylinder and a second cylinder symmetrically arranged around a center of the gas groove, two gas flowing holes defined in the base and communicating with the gas groove, the first cylinder and the second cylinders, a first inlet formed on a side wall of the gas groove and communicating with an exterior of the gas groove, and a first outlet defined on a bottom end of the gas groove and communicating with the exterior of the gas groove, wherein the base also includes the a holder connected with a top surface thereof for covering the gas groove, the first cylinder, and the second cylinder, a bottom plate of the holder has two first orifices, two second orifices, a third orifice between the two first orifices, a fourth orifice between the two second orifices, and plural fifth orifices formed thereon, the first orifices and the third orifice communicate with the first cylinder, and the second orifices and the fourth orifice communicate with the second cylinder;

a gas valve including one end formed in a circle shape and a connecting rod connected on a central position of a top surface thereof, the gas valve being disposed in the gas groove and also including a second inlet for communicating with the two gas flowing holes and the first inlet and including a second outlet for communicating with the first outlet; wherein an angle between the second inlet and the second outlet is 90 degree, and the gas valve also includes a first bearing, mounted on the top surface of the gas valve, extending out of the third orifice and the fourth orifice the bottom plate, and connecting with a second bearings inserted into the third orifice and the fourth orifice so as to couple with a driven gear of a gear set of a driving device;

a holder connected with the top surface of the base and formed in a hollow square shape, the bottom plate of the holder having the two first orifices, the two second orifices, the third orifice, the fourth orifice, and the plural fifth orifices formed thereon, the holder being formed in the hollow square shape so as to receive the gear set and the driving device;

the driving device including two pushing posts for connecting with two pistons, a rotating arm formed in a cross shape and coupling with the two top ends of the two pushing posts, a rotary shaft connecting with a top end of the rotating arm, and the gear set coupling with a bottom end of the rotating arm; wherein the two pushing posts include the two pistons disposed on two bottom ends thereof and inserted into the first cylinder and the second cylinder through a bottom end of the holder; the rotating arm includes a tube having two receiving spaces, two supports having two first ends inserted into the two receiving spaces and two second ends coupling with the two top ends of the two pushing posts, a first guide peg having a first segment connecting with a top rim of the tube and a second segment fixed in the first rotatable bearing of the first opening, and a second guide peg having a first side coupling with a bottom rim of the tube and a second side symmetrical to the first guide peg, such that the rotating arm is formed in the cross shape, and the tube also has two apertures formed thereon for communicating with the two receiving spaces so that the two supports move in the two receiving spaces reciprocately;

the gear set includes a panel having two ends connecting with the bottom plate of the holder so as to form a room, an upper gear and a bottom gear inserted into and being coaxial with a top portion of the panel, a drive gear and the driven gear coupling with the bottom portion of the panel by using two rotary stems and meshing with the upper gear and the lower gear, wherein the drive gear has a second tilted bar mounted thereon for corresponding to a first tilted bar, the second tilted bar has a second opening arranged thereon, a second rotatable bearing received in the second opening, such that a distal end of the second guide peg inserts in the second rotatable bearing, and a rotary stem of the driven gear is in connection with a top end of the connecting rod of the gas valve so that when the drive gear rotates two circles, the driven gear is driven by the upper gear and the lower gear to rotate one circle, so the gear set is used to control a rotating speed ratio of the rotary shaft or the rotating arm and the gas valve, and the rotating speed ratio is □ two times; the rotary shaft includes a vertical extension and a horizontal extension being perpendicular to the vertical extension and in connection with the vertical extension, wherein the vertical extension extends out of the seat and is connected with the seat by a third bearing, the horizontal extension located under the seat and has a first tilted bar obliquely extending from one end thereof, and the first tilted bar has an first opening defined thereon, the first opening has a first rotatable bearing secured therein, a distal end of the gear set connects with the connecting rod of the gas valve;

the seat including a peripheral side coupling with a top rim of the holder, a fixed pole axially connecting with the holder and the base; wherein a top end of the rotary shaft extends out of the seat.

2. The four-stroke engine without the crankshaft and the valves as claimed in claim 1, wherein a limit height in the first cylinder and the second cylinder is determined based on the rotary shaft, the rotating arm, the two pushing posts, and the two pistons, such that the first cylinder and the second cylinder have various compression ratios so that the four-stroke engine is applicable for various fuels.

3. The four-stroke engine without the crankshaft and the valves as claimed in claim 1, wherein the four-stroke engine is applicable for diesel fuel and gasoline fuel, and when the gasoline fuel is used to drive the four-stroke engine, the first cylinder and the second cylinder have to fix a first spark plug and a second spark plug.

* * * * *